US006070874A

United States Patent [19]

Ivers

[11] Patent Number: 6,070,874

[45] Date of Patent: Jun. 6, 2000

[54] QUIZZOR QUESTION AND ANSWER GAME METHOD AND ASSOCIATED ITEMS

[75] Inventor: Thomas P. Ivers, Bryn Mawr, Pa.

[73] Assignee: Intelligames Ltd., Bryn Mawr, Pa.

[21] Appl. No.: 09/110,918

[22] Filed: Jul. 6, 1998

[51] Int. Cl.[7] ..... A63F 1/00

[52] U.S. Cl. ..... 273/292; 273/431

[58] Field of Search ..... 273/429, 430, 273/431, 272, 274, 292, 298, 299, 300

[56] References Cited

U.S. PATENT DOCUMENTS

| | | | |
|---|---|---|---|
| 4,201,388 | 5/1980 | Cantelon . | |
| 4,326,711 | 4/1982 | Giallombardo . | |
| 4,666,161 | 5/1987 | Elesie . | |
| 4,807,878 | 2/1989 | Tripp | 278/1 E |
| 5,054,775 | 10/1991 | Banks et al. | 273/431 |
| 5,121,928 | 6/1992 | Salerno-Sonneberg | 273/243 |
| 5,186,467 | 2/1993 | Chasin | 273/298 |
| 5,257,939 | 11/1993 | Robinson et al. | 434/129 |
| 5,375,846 | 12/1994 | Smith | 273/292 |
| 5,516,111 | 5/1996 | Strickland, Jr. | 273/269 |
| 5,551,700 | 9/1996 | Druce et al. | 273/296 |
| 5,746,431 | 5/1998 | McIntyre et al. . | |

OTHER PUBLICATIONS

Jeopardy™ Home Game, Instructions for Playing© 1986 Pressman Toy Corporation, New York, N.Y.

"Quizzor"—(Question & Answer "box" game) Copyright Reg. TXu 650–483 and deposit materials, Jul. 19, 1994.

*Primary Examiner*—William M. Pierce

*Attorney, Agent, or Firm*—Volpe and Koenig, P.C.

[57] ABSTRACT

A question and answer game with associated items is played by a plurality of players. The questions are divided into categories with a predetermined number of questions in each category. Each question has assigned odds.

A responding player selects one of the categories. The responding player is advised of the odds of one of the questions within the selected category. Players wager based on whether the question will be answered correctly. After the responder answers, players gain or lose based on the question's odds and whether the responder's answer is correct.

12 Claims, 5 Drawing Sheets

10

SPORTS 20

21

NICKNAMES OF PROFESSIONAL GOLFERS
(Identify the golfer or the nick-name.)

22

Example Question
Q. "The Golden Bear"
A. Jack Nicklas

| Q. # | Odds | CARD PRICE 23 $400 | CARD POTENTIAL 24 $11,200 |
|---|---|---|---|
| 1 25 | 1-1 26 | Q. "Boom-Boom"<br>A. Fred Couples | 27 |
| 2 25 | 2-1 26 | Q. The "Walrus"<br>A. Craig Stadler | 27 |
| 3 25 | 3-1 26 | Q. JoAnne Carner<br>A. "Big Momma" | 27 |
| 4 25 | 3-1 26 | Q. Orville Moody<br>A. "Sarge" | 27 |
| 5 25 | 3-1 26 | Q. "Terrible-tempered"<br>A. Tommy Bolt | 27 |
| 6 25 | 4-1 26 | Q. "The Iceman"<br>A. Ben Hogan | 27 |
| 7 25 | 7-1 26 | Q. Mike Reid<br>A. "Radar" | 27 |

FIG. 2

SELECTION PROCESS 30

QUIZZOR QUESTION AND ANSWER GAME METHOD AND ASSOCIATED ITEMS

BACKGROUND OF THE INVENTION

1. Field of the Invention

This invention relates generally to games and more particularly to question and answer games, trivia games, card games and wagering games.

2. Description of the Prior Art

Games involving trivia are well known in the art. Typically, such games require a playing board on which the progress of all players is identified by tokens of varying types. Forward movement along the board is determined by a combination of dice rolls, spinners and correct answers to questions. Selection of the questions is totally at random. Players neither choose nor control the subject matter.

Additionally, these games do not include wagering. Questions are not defined as to difficulty. Only one individual at a time plays as others await their turn. The winner is merely the player who navigates a series of blocks or hazards to a finish line.

One game in this genre is U.S. Pat. No. 5,054,775 (Banks et al.). In Banks, a player selects a question card. The question card has four questions and answers, each pertaining to four distinct categories. The player also selects a category card. The category card indicates which question should be asked from the question card. If the player answers correctly, another player rolls a pair of dice. The number rolled is added to the player's score. The winner is the player with the highest score.

Another prior art game is Trivial Pursuit. Trivial Pursuit involves players traveling around a board by rolling a die. Each space is associated with a particular category. For example, in the Silver Screen Edition, the categories are settings, titles, off-screen, on-screen, production and portrayals. Upon landing on a space, a player is asked a question. If answered correctly, the player rolls again. There is only one headquarters space for each category. If a player lands on a headquarters space and answers a question correctly, the player receives a wedge. When a wedge is obtained for each category, the player must move to the center of the board and answer a question correctly to win.

A prior art trivia game involving money is the home version of the television show Jeopardy. In Jeopardy, players pose questions in response to an answer. The answers are divided among several categories. A player selects an answer based on a designated dollar value and the category. The first player to ring in may attempt to pose the correct question. If the player poses the correct question, the player wins the designated amount. If the player answers incorrectly, the player loses the designated amount and other players can ring in to answer the question. The winner is the player with the most money at the end of the game.

SUMMARY OF THE INVENTION

The present invention provides a method for playing a question and answer game as well as items for use in playing the game. The questions are divided into categories. Each category has a predetermined number of questions. Each question has assigned odds.

A responding player selects one of the categories. He/she (he) is advised of the odds of one of the questions within the category. Players wager based on whether the question will be answered correctly. After the responding player answers the question, players gain or lose based on the question's odds and whether the question was answered correctly.

Accordingly, it is an object of the present invention to overcome the disadvantages of the prior art games.

BRIEF DESCRIPTION OF THE DRAWINGS

FIG. 2 is a top plan view of the face of one of the topic cards shown in FIG. 1.

DESCRIPTION OF THE PREFERRED EMBODIMENTS

The preferred embodiments will be described with reference to the drawn Figures wherein like numerals represent like elements throughout.

Figure 1:
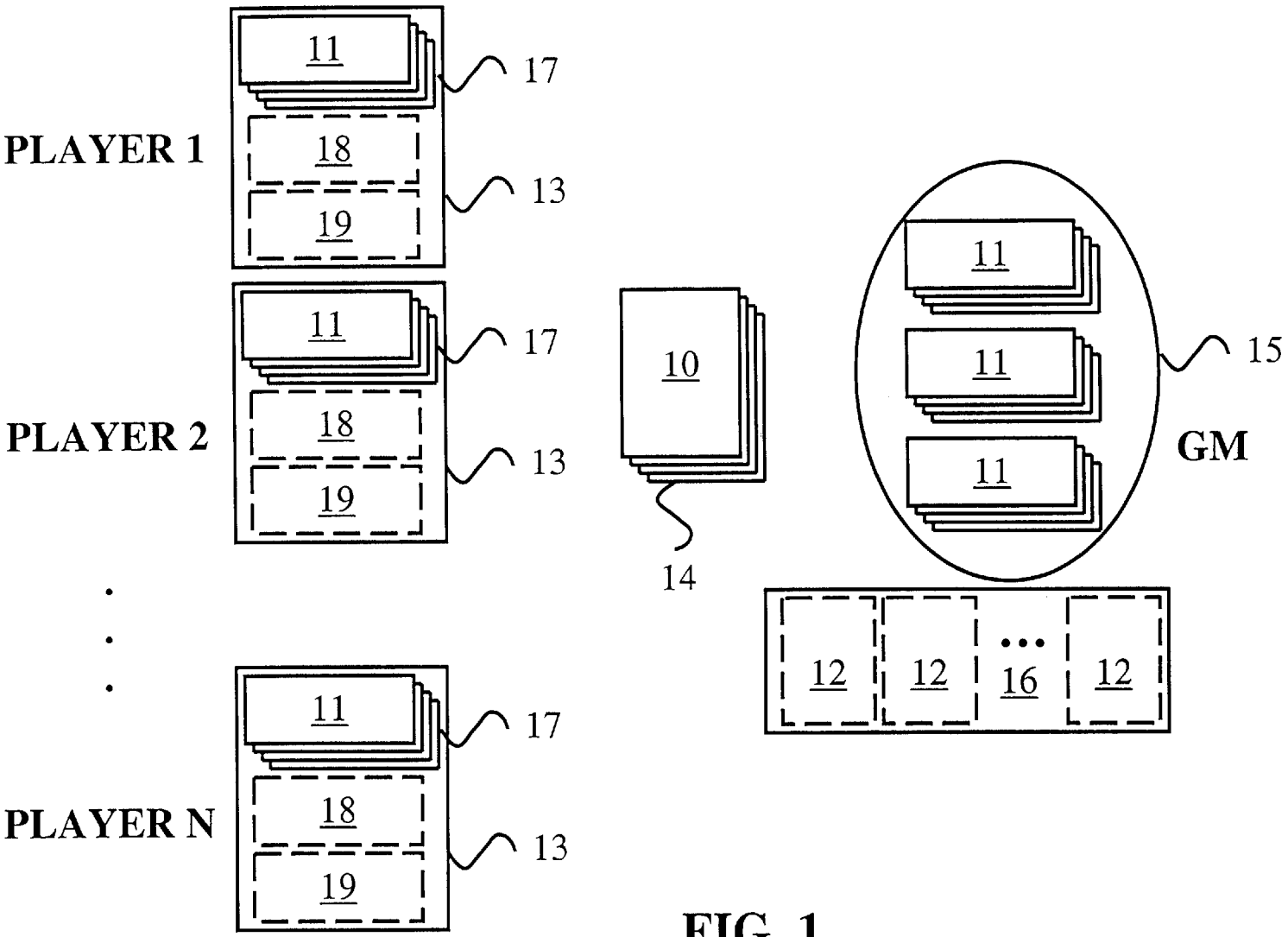
FIG. 1 is an isometric view of the associated gaming items in accordance with the teachings of the present invention including a deck of topic cards face down.

FIG. 1 illustrates all of the gaming components of the instant invention as arranged during a game. A non-playing game manager (GM) has a bank 15 of money 11, a deck 14 of topic cards (cards) 10 and a slotted display rack 16. Slots 12 within the display rack can hold cards 10. Each player during a game starts with a bankroll 17 of money 11 kept on a game tray 13.

FIG. 2 depicts the face of a card 10. The card 10 has a category title 20, a topic 21, an example question and answer 22, a card price 23, a card potential 24, a number, preferably seven, of questions and answers 27. For each question and answer 27, the card 10 includes a question number 25 and odds 26 based on the difficulty of the question.

The title 20 of each card 10 broadly describes the general category that all the card's questions and answers 27 pertain, i.e. Sports. The topic 21 gives a description of a special topic within the category to which the card's question and answers 27 pertain, i.e. Nicknames of Professional Golfers (identify the golfer or the nickname). The example question and answer 22 is representative of the card's questions and answers 27, i.e. Q. "The Golden Bear", A. Jack Niklaus.

The card price 23 is the price that the card 10 will be offered during the selection process which will be described in more detail later. The card potential 24 is the amount of money 11 that a player answering all questions correctly could win by wagering a predetermined maximum on each question.

Preferably, the cards 10 all have seven questions and answers 27, although the number of questions is not critical and a different number could be used on some or all cards 10. Preferably, each question and answer 27 has a question number 25 which is sequential, i.e. 1, 2, . . . , n. For convenience, a question and answer 27 with a question number 25 of n will be referred to as Question n in the following discussion.

Solo Play

A first preferred embodiment of the instant invention is Solo. Solo is played with three to six individuals. However, those skilled in the art will realize that the instant invention could be played with more than six individuals or less than three, particularly with the aid of a computer.

One of the individuals is designated as the non-playing GM. The remaining individuals are the players and are designated: player 1, player 2, . . . , player n. If a computer is utilized to play the game, the role of GM and/or some of the players could be simulated by the computer. The GM asks the questions and acts as a banker.

a) Set Up

At the beginning of the game, the GM has the entire deck 14 of cards 10, the bank 15 of money 11 and a slotted display rack 16. Each player has a game tray 13 and the GM gives each player a bankroll 17 of money 11, preferably $3,000 in $100 denominations although other amounts and/or denominations could be designated.

b) Selection Process

Figure 3:
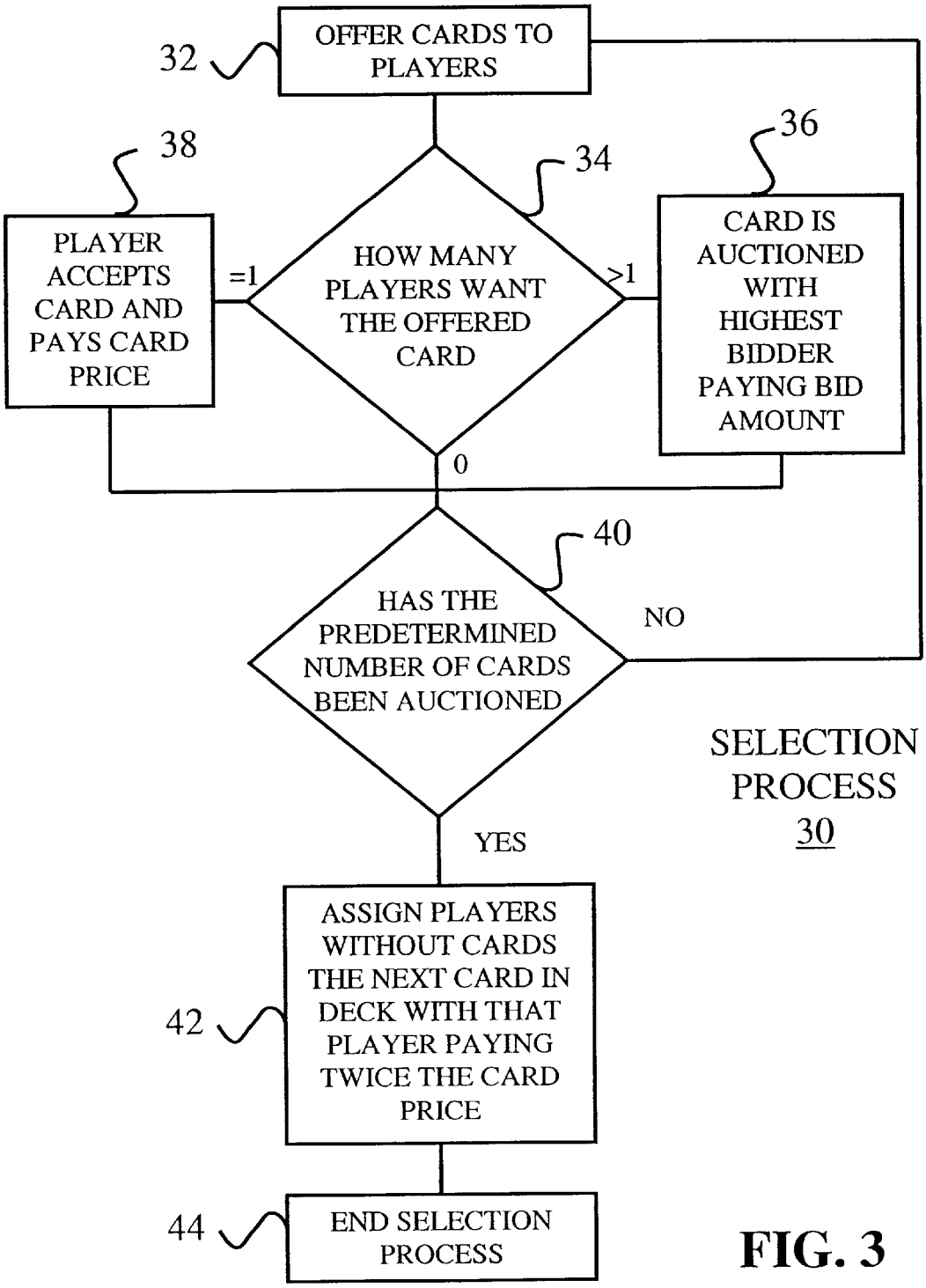
FIG. 3 is a flow chart of the selection process.

The first phase of play of the Solo game is the Selection Process 30 and will be described in conjunction with FIG. 3. During the Selection Process 30, cards 10 are offered to the players, step 32. The GM offers a card 10 to the players by reading the topic 21, an example question and answer 22, the card's price 23 and the card's potential earnings 24.

After the GM discloses this information, each player is eligible to accept or reject the card 10, step 34. If a single player is the only one to accept the card 10, the card price 23 is paid to the bank 15, step 38. The accepting player is the exclusive owner of that card 10. Subsequently, the card 10 is placed in a slot on the GM's display rack 16. Once a player owns a card 10, that player cannot take another card 10.

If no player accepts a particular card 10, the GM places the card 10 at the rear of the deck 14 and extracts the next front-most card 10 as another offering.

If more than one player desires a card 10, the GM auctions the card 10, step 36. The GM offers the card 10 at the card price 23 to the players. Subsequently, the GM increases the price, usually in increments of $100, although other amounts can be used. This process is repeated until only one player accepts the increased price. The accepting player owns the card 10 and pays the final bid to the bank 15.

This process of offer, acceptance, rejection and auction is repeated for a predetermined number of cards 10. The number of cards 10 offered during the Selection Process will vary according to the number of individuals. One possible designation would be in a three individual game to offer eight cards 10, in a four or five individual game to offer ten cards 10 and in a six individual game to offer twelve cards 10. However, the number of cards 10 offered is not critical and other numbers could be used.

Once the predetermined number of cards 10 has been offered, step 40, any player who does not own a card 10 is assigned the next card 10 in the deck 14 and the player must pay twice the card price 23 to the bank, step 42. At this point each player owns a card 10 and all of the owned cards 10 are kept by the GM in the slotted display rack 16, step 44.

c) Quizzing Process

Figure 4:
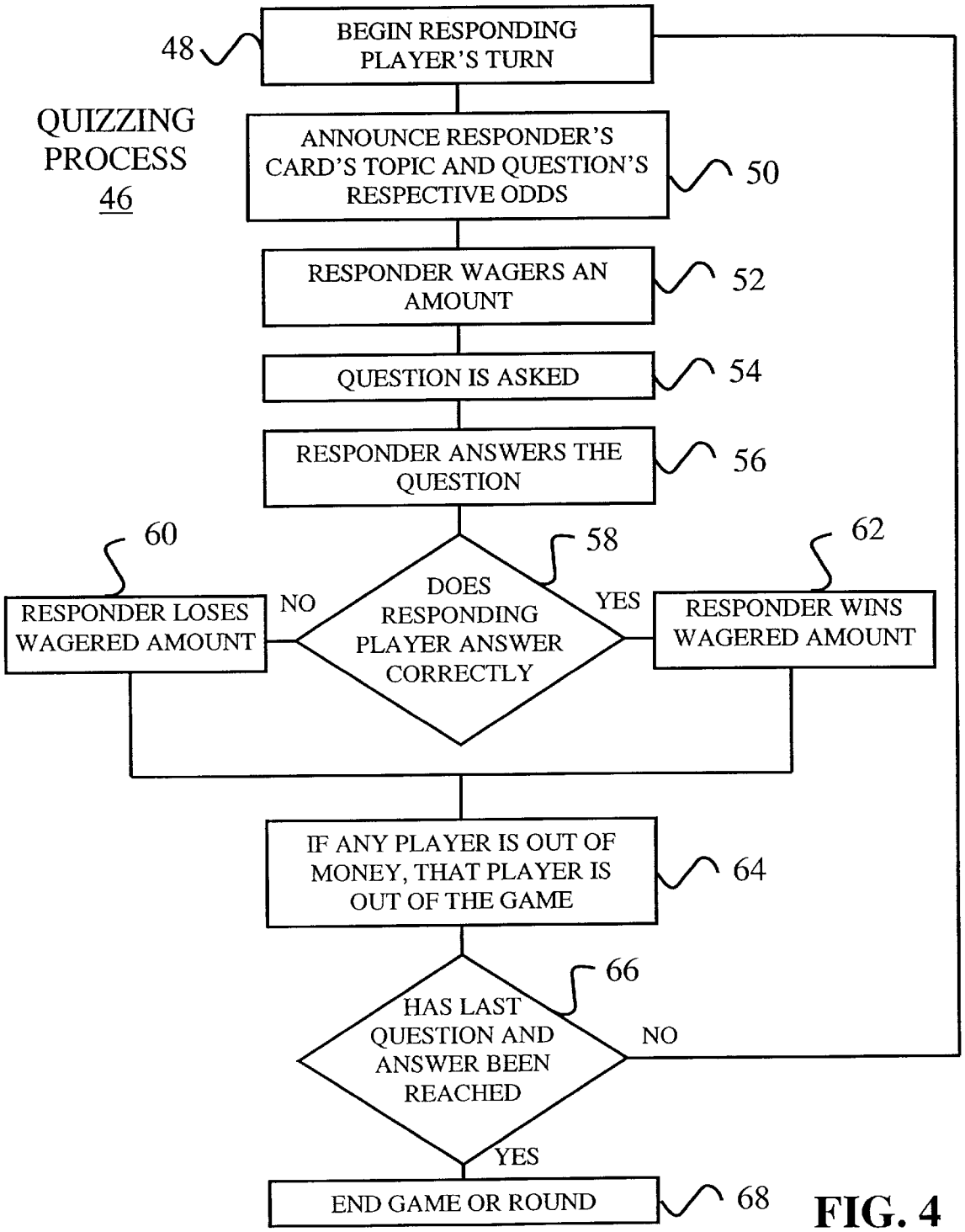
FIG. 4 is a flow chart of the quizzing process.

After the Selection Process in which each player is assigned a card 10, the quizzing process 46 begins which will be described in conjunction with FIG. 4. Each player is sequentially given a turn beginning with player 1, step 48. During a player's turn, the player is designated as the responder. To begin, the GM announces the responder's cards's topic subject matter 21 and the respective odds 26 for Question 1, step 50. The responder makes a wager on Question 1 by placing money 11 on his game tray 13, step 52.

The GM asks the responder the question associated with Question 1, step 54. If the responder answers correctly, the responder's wager, multiplied by the question's odds 26, is paid from the bank 15, i.e. a wager of $300 at 5 to 1 odds pays $1,500, step 58 and 62. If the responder answers incorrectly, the GM takes the wagered money 11 from the responder's game tray 13 and places it in the bank 15, step 58 and 60. The responder's turn has then ended. If any player including the responder is out of money 11 at the end of a turn (bankrupt), that player is out of the game and cannot continue to play, step 64. His card 10 is placed at the back of the deck 14.

Each player 2, 3, . . . , n subsequently takes their turn as responder. After each player has taken their turn, the GM repeats the process for all players remaining in the game using Question 2. This process continues until the last question and answer 27 on each player's card 10. The amount of the wager preferably ranges from $100 to $300. For the last question (typically Question 7), the maximum wager is preferably increased to $1,000. Another range could be designated prior to the game, however, the card potential 24 is based on whatever predetermined maximum wager amounts are set at the time of printing (or if done electronically, at the time of display).

d) Winning

There are three ways a player is designated the winner of a game. First, after the last player's final question, the player with the largest bankroll 17 is the winner, step 66 and 68. Second, if all but one player is bankrupt, the remaining player is designated the winner. However, the player who was not fully paid his wager by the bank has the unpaid amount added to his bankroll 17. The player with the largest total is the winner. Third, if the bank 15 is unable to pay off a player's wager because it is out of money 11, the game ends. The player with the largest money total is the winner.

Challenge Play

Figure 5:
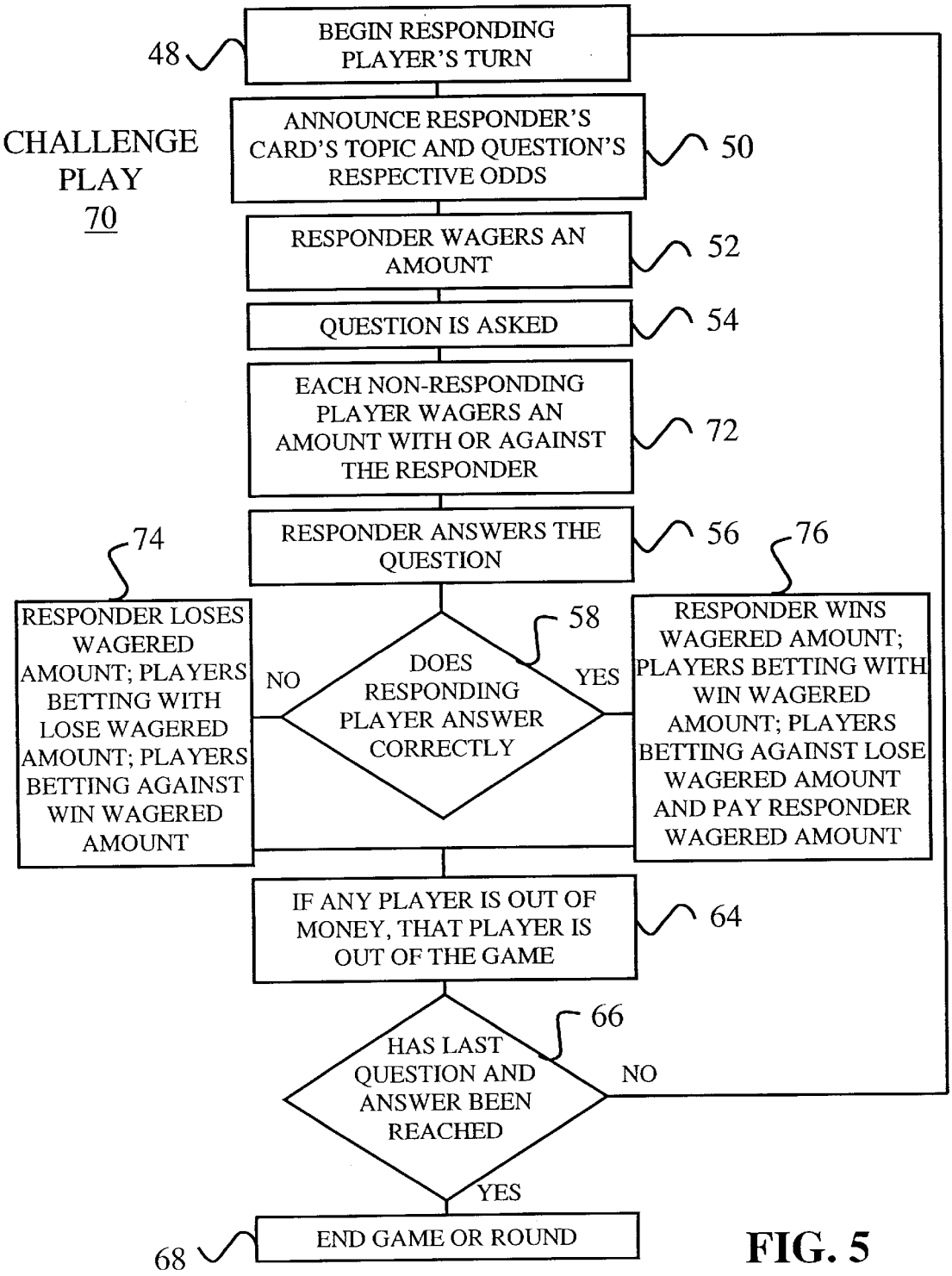
FIG. 5 is a flow chart of challenge play.

Challenge play 70 of the game is similar to Solo. In Challenge 70, the Selection Process is performed in the exact same manner as is in Solo which will be described in conjunction with FIG. 5. However, the Quizzing Process is slightly different. As in Solo, the GM tells the responder the card's topic subject matter 21 and odds 26 for a particular question, step 50. The responder wagers by placing money 11 on his game tray 13, step 53.

Unlike Solo, after hearing the question, all of the other players (designated as opponents) may wager that the responder will answer correctly or incorrectly. The opponents wager by placing money 11 on their game trays 13 in either of two slots 18, 19, one slot 18 for betting with the responder and the other 19 for betting against, step 72. The amount of money 11 opponents may wager is preferably set at $200 although other amounts could be designated. If the responder answers correctly and an opponent bet with the responder, the opponent collects $200 from the bank 15, step 76. If the responder answers incorrectly and the opponent bet against the responder, the opponent collects $200, step 74. If the responder answers incorrectly and the opponent bet with the responder or conversely if the responder answers correctly and the opponent bet against the responder, the opponent gives the $200 in the game tray 13 and an additional $200 from his bankroll 17 to the responder, step 72. The remainder of the game is played the same as in Solo.

Multi-Round Play

Another variation of the game is Multi-Round play. Multi-Round can be played using either the Solo or Challenge play format. Multi-Round is typically played by dividing the game into two or three consecutive rounds, although more rounds could be added.

In Multi-Round, the first round is played the same as either Solo or Challenge with two exceptions. First, the initial bankroll 17 given to each player will be larger, for instance $4,500 for a two-round game and $6,000 for a three-round game. Second, a winner is not determined until the conclusion of the last round. Each player keeps the same bankroll 17 for each successive round.

After the final question in the first round, all of the used cards 10 are retrieved and placed at the rear of the deck 14. A new Selection Process is performed. The Quizzing Process is performed the same as in the previous round. In a three-round game, this process is repeated for an additional round. Additional rounds could be added for even longer games. The player with the largest bankroll 17 at the end of the final round is the winner.

Fast Track Play and Other Variations

Fast Track play speeds up the play of the game. Fast Track can be used with any of the previously mentioned embodiments: Solo, Challenge and Multi-Round. In Fast Track, instead of asking each responder a single question in turn, each responder is quizzed on multiple or all card questions successively before the next player becomes responder. By not switching between players as often, game play can be accelerated.

Another version of the game would replace the question and answer cards with a question and answer book or an electronic question and answer display device. Game play would essentially be the same with players owning a specific topic in a category instead of a card. The game could also be played with chips instead of money.

Although the invention has been described in part by making detailed reference to certain specific embodiments, such details are intended to be instructive rather than restrictive. It would be appreciated by those skilled in the art that many variations may be made in the structure and mode of operation without departing from the spirit and scope of the invention as disclosed in the teachings herein.

What is claimed is:

1. A method of playing a question and answer game by a plurality of players comprising the steps of:

a) providing a plurality of question topics, each topic having a predetermined number of questions, each question having a predetermined assigned odds value;

b) at least a first player selecting one of said topics;

c) advising said first player of the odds value of a selected question within the topic selected by said first player;

d) said first player wagering an amount based on whether said selected question will be answered correctly and at least one player other than said first player wagering an amount based on whether said selected question will be answered correctly;

e) said first player providing an answer to said selected question;

f) gaining or losing an amount by wagering players according to the provided answer, a respective answer, the wagered amount and the odds value of the selected question; and g) repeating steps c, d, e, and f a selected number of times where a different one of said questions of said selected topic serves as said selected question.

2. The method according to claim 1, wherein step (f) comprises:

(f1) gaining an amount by said first player equal to the wagered amount multiplied by the odds value of said selected question if the provided answer is correct; and (f2) losing an amount by said first player equal to the wagered amount if the provided answer is incorrect.

3. The method according to claim 2, wherein step (f) further comprises:

(f3) gaining an amount by each wagering player excluding said first player equal to the amount wagered if said respective wagering player wagered said first player would answer correctly and said first player answered correctly or said first player answered incorrectly and said first player answered incorrectly; and (f4) losing an amount by each wagering player excluding said first player equal to twice the amount wagered if said respective wagering player wagered said first player would answer correctly and said first player answered incorrectly or said first player would answer incorrectly and said first player answered correctly.

4. The method according to claim 1 further comprising the step of:

offering at least one of said topics to at least said first player at an assigned amount.

5. The method according to claim 4 further comprising:

at least one of said plurality of players selecting one of said topics by paying an amount equal to said assigned amount.

6. The method according to claim 1 wherein step (b) comprises a subset of said plurality of players including a first player, each selecting one of said topics, further comprising the step of:

repeating steps c, d, e, and f with each player of said subset subsequently becoming said first player.

7. The method according to claim 1 wherein step d further comprises:

(d1) asking said first player said selected question after said first player's wager and before said at least one other player's wager.

8. The method according to claim 1 wherein a respective plurality of cards contain said predetermined number of questions for each respective category.

9. The method according to claim 1 wherein an amount is an amount of money.

10. A method of playing a question and answer game by a plurality of players comprising the steps of:

a) providing a plurality of question categories, each category having a predetermined number of questions, each question having a predetermined assigned odds value;

b) offering at least one of said plurality of categories to said plurality of players for selection;

c) when only a single player of said plurality of players desires one of said at least one category, that single player's desired category is selected for that single player;

d) when more than one player of said plurality of players desires one of said at least one category, each of said more than one player sequentially offers increased amounts for that more than one player's desired category until none of said more than one player offers an increased amount and said player offering a highest of the increased amounts selects said topic by paying an amount equal to the highest increased amount;

e) at least a first player having a selected one of said plurality of categories;

f) advising said first player of the odds value of a selected question within the category selected by said first player;

g) at least one player wagering an amount based on whether said selected question will be answered correctly;

h) said first player providing an answer to said selected question;

i) gaining or losing an amount by wagering players according to the provided answer, a respective answer, the wagered amount and the odds value of the selected question; and j) repeating steps f, g, h, and i a selected number of times where a different one of said questions of said selected category serves as said selected question.

11. The method of claim 10 wherein each of said at least one category has an associated price based on a difficulty of said category's questions and said single player paying said single player's desired category's price.

12. The method of claim 10 further comprising for each said offered category making an example question available to said plurality of players prior to step c.

* * * * *